US005878440A

United States Patent [19]

Smaidris

[11] Patent Number: 5,878,440

[45] Date of Patent: Mar. 9, 1999

[54] TAP DANCE SOCKS

[76] Inventor: Cheryl A. Smaidris, 14829 Innisbrook La., Lockport, Ill. 60441

[21] Appl. No.: 86,099

[22] Filed: May 28, 1998

[51] Int. Cl.[6] ..... A43B 17/00

[52] U.S. Cl. ..... 2/239; 36/8.3; 36/139

[58] Field of Search ..... 2/239, 241, 242, 2/22, 61, 80, 23; 36/8.3, 113, 132, 139, 7.1 R; 446/26

[56] References Cited

U.S. PATENT DOCUMENTS

| | | | |
|---|---|---|---|
| Re. 17,753 | 7/1930 | Haney . | |
| 1,877,080 | 9/1932 | Teshima . | |
| 2,219,235 | 10/1940 | Morton . | |
| 2,443,609 | 6/1948 | Du Mont et al. . | |
| 2,479,428 | 8/1949 | Sunseri | 36/8.3 |
| 2,721,420 | 10/1955 | Chatten . | |
| 2,723,467 | 11/1955 | Cassidy . | |
| 2,739,394 | 3/1956 | Morgan | 36/8.3 |
| 3,121,287 | 2/1964 | Patterson | 36/8.3 |
| 3,411,222 | 11/1968 | Williams | 2/24 |
| 3,501,144 | 3/1970 | Schmidt | 446/26 |
| 4,069,515 | 1/1978 | Swallow et al. | 2/239 |
| 4,253,254 | 3/1981 | Gill | 36/139 |
| 4,288,930 | 9/1981 | Bornell . | |
| 4,463,506 | 8/1984 | Isackson | 36/139 |
| 4,787,100 | 11/1988 | Jonat | 2/80 |

*Primary Examiner*—Amy B. Vanatta
*Attorney, Agent, or Firm*—Hovey, Williams, Timmons & Collins

[57] ABSTRACT

A tap dance sound producing apparatus (20) utilizes an attachment member (22) and sound producing members (24, 26). The attachment member preferably comprises a sock having a ground engaging surface (36). The sound producing members (24, 26) are preferably grommets which reinforce openings (32, 34) in the ground engaging surface (36) of the sock. An attachment member (22) is pulled onto each of a dancers feet (30, 56) and the sound producing members (24, 26) strike the ground as the dancer dances to produce a tap sound.

20 Claims, 1 Drawing Sheet

TAP DANCE SOCKS

BACKGROUND OF THE INVENTION

1. Field of the Invention

The present invention is broadly concerned with improved footwear particularly designed for dancing. More particularly, the invention pertains to such footwear wherein noise making members are attached to dancers' feet. In preferred forms, resilient tubular members with attached tap sound producing members slide over dancers' shoes.

2. Description of the Prior Art

In a properly structured program, dance can be used as a vehicle through which fitness is taught and obtained for both children and adults, and recognizing that one of the most popular forms of dance is tap dancing, because of the tap sound, tap dancing is especially suited to spark a fitness interest in both children and adults. Therefore, there is a desire to utilize tap dancing in the physical education programs of schools and other organizations. However, because of the cost of tap shoes and because it is difficult, if not impossible, to create an interest in tap dancing without the tap sound, tap dancing is not a feasible option for most organizations.

Alternatives to tap shoes have been proposed, but the alternatives have fallen short of providing a viable solution to expensive tap shoes. In general, the alternatives have failed to sufficiently reduce cost, damage the footwear to which they are attached, fail to properly position tap sound producing pieces on the foot, and fail to satisfactorily secure tap sound producing pieces to the foot during dancing. Therefore, there remains a need for a low cost tap sound producing apparatus.

SUMMARY OF THE INVENTION

The present invention solves the problems mentioned above and provides a distinct advance in the state of the art. In particular, the invention is directed to a tap dance sound producing apparatus which produces a tap sound when utilized by a dancer. The apparatus has an attachment member and a tap sound producing member connected to the attachment member.

In a preferred embodiment, the attachment member comprises a generally tubular sock having a closed toe end and a ground engaging surface. The sound producing member is attached to the ground engaging surface adjacent to the closed toe end. The sock is preferably sized to fit over and substantially enclose a shoe of a dancer although, for an adult shoe, the sock may only fit over a portion of the shoe. When the sock is slid over a shoe, the sound producing member is generally parallel to a sole of a shoe. The sound producing member preferably comprises a metal ring having a central opening such as a grommet which reinforces an opening in the attachment member. It will be appreciated that other materials such as plastic can be used as the sound producing member. The lower surface of the sound producing member is rounded and smooth. Preferably, a second sound producing member is also connected to the attachment member and is juxtaposed the first sound producing member. Both sound producing members are preferably adjacent to the toe end of the sock.

DETAILED DESCRIPTION OF THE PREFERRED EMBODIMENT

Figure 1:
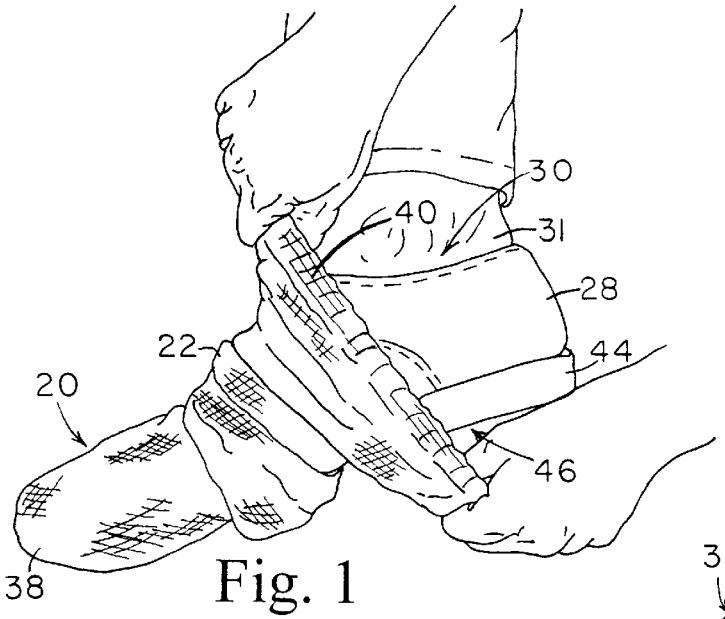
FIG. 1 is a perspective view illustrating introduction of a dancer's foot into a tap dance sound producing apparatus according to the present invention.
Figure 2:
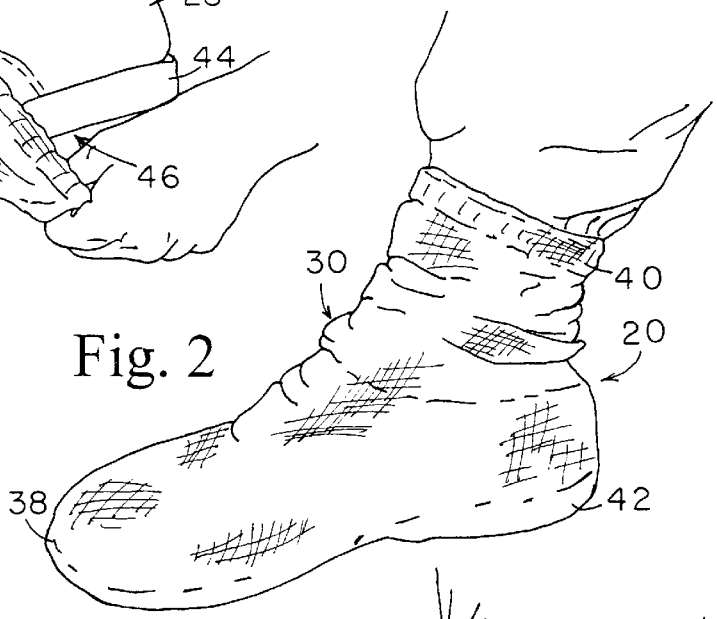
FIG. 2 is a perspective view of the tap dance sound producing apparatus of FIG. 1 on the right foot of a dancer.
Figure 5:
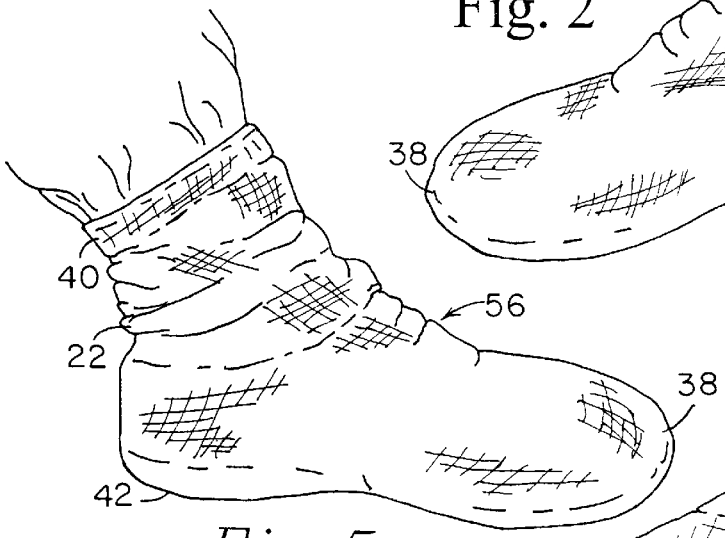
FIG. 5 is a perspective view of another tap dance sound producing apparatus according to the present invention on the left foot of a dancer.
Figure 3:
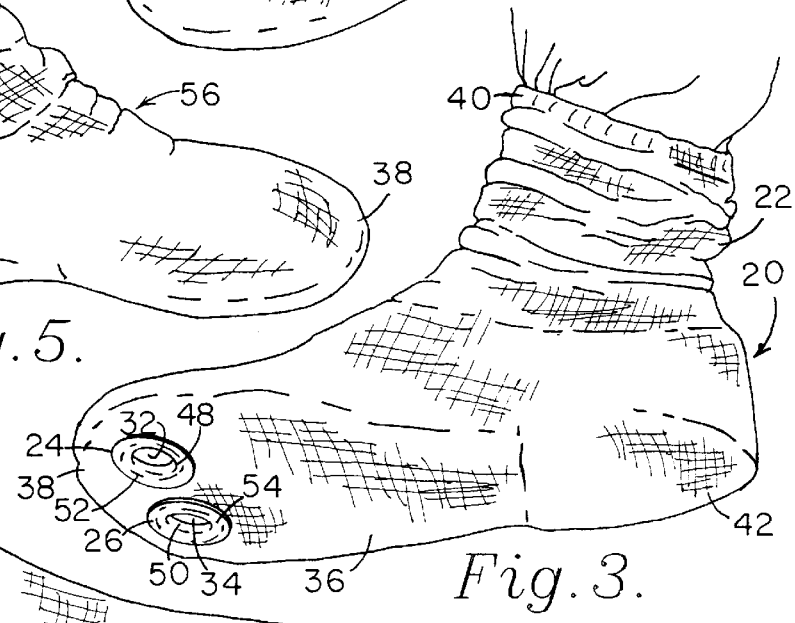
FIG. 3 is a perspective view of the tap dance sound producing apparatus of FIG. 1 illustrating a bottom, ground engaging surface of the apparatus.
Figure 4:
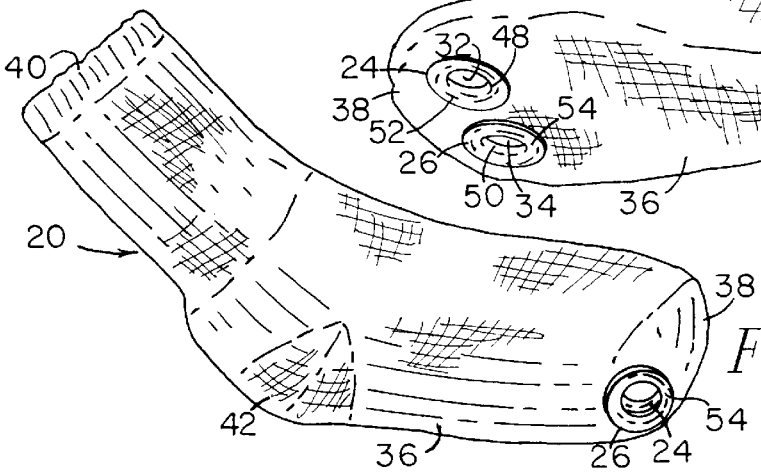
FIG. 4 is a side elevational view of the tap dance sound producing apparatus of FIG. 1.

FIGS. 1 through 5 illustrate a preferred tap dance sound producing apparatus, generally designated 20, in accordance with the present invention. The apparatus 20 includes an attachment member 22 and first and second tap sound producing members 24, 26. The attachment member 22 slides over the shoe 28 and foot 30 of a dancer, so that the tap sound producing members 24, 26 engage the ground and make tap sounds while the dancer dances.

The attachment member 22 is generally tubular having an tubular axis, and the attachment member is elongated in the direction of the tubular axis. The attachment member is fabricated with a flexible and expandable material such as a cloth material commonly used in the production of socks. Because the attachment member is flexible, it is substantially conformable to the dancer's shoe when the shoe is inserted into the attachment member. The attachment member is preferably sized to slide over the shoe 28 of the dancer thereby substantially enclosing both the dancer's foot 30 and shoe 28. The attachment member is preferably elongated enough to cover at least the lower portion of the dancer's ankle 31. The attachment member includes first and second openings 32, 34 in a ground engaging surface 36 thereof.

In a preferred embodiment, the attachment member comprises a sock made of a heavy weight material and having a closed toe end 38, a heel portion 42, and an open insertion end 40. The insertion end 40 is opposite the toe end 38, and the heel portion is positioned therebetween. The ground engaging surface 36 of the sock coincides with the toe end 38 and the heel portion 42.

The sock 22 also preferably includes a sole 44 which is preferably provided on the shoe 28 but can be provided with the sock. The sole is received in the sock and positioned adjacent to the ground engaging surface 36, so that the sole is interposed between the tap sound producing members and the foot of the dancer. In this configuration, a bottom surface 46 of the sole is parallel to the ground engaging surface 36. The sock can also include a gripping material (not shown) located on the ground engaging surface 36.

The tap sound producing members 24, 26 are preferably metallic grommets which reinforce the openings 32, 34 in the ground engaging surface 36 of the sock 22. The grommets 24, 26 are ring-shaped and include central openings 48, 50 which coincide with the openings 32, 34 in the sock 22. The lower surfaces 52, 54 of the grommets are substantially smooth and are rounded, so that the lower extremities, which are located substantially centrally in the rings, of the lower surfaces extend below the edges thereof. That is, the lower surfaces are convex when viewed for the exterior of the sock. Hot melt glue is applied to the cut edges of sock 22 surrounding openings 32, 34 before installing members 24, 26 to prevent fraying of the sock material and to help retain members 24, 26 in place.

The sound members are connected to the attachment member adjacent to the closed toe end 38 of the sock 22 and are juxtaposed to each other. If desired, one of the sound members or additional sound members can be positioned at the heel portion 42 of the sock 22. The sock operates to hold the sound members against the bottom surface 46 of the shoe sole 44, so that the sound producing members are generally parallel with the sole 44.

In operation, the dancer slides a tap dance sound producing apparatus on to both right 30 and left 56 feet, so that the grommets are held against the bottom surface 46 of the sole 44 of the dancer's shoes 28. While performing a dance or practicing dance steps, the sound members 24, 26 engage the ground and create a tap sound. Thus, the dancer is encouraged to continue tap dancing thereby increasing the fitness of the dancer. The tap dance sound producing apparatus 20 according to the present invention provides an inexpensive alternative to tap dancing shoes allowing organizations to utilize tap dancing in physical education and fitness programs.

Those skilled in the art will appreciate that the present invention encompasses many variations in the preferred embodiment described herein.

Having thus described that embodiment, the following is claimed as new and desired to be secured by Letters Patent:

1. A tap dance sound producing apparatus for producing a tap sound when utilized by a dancer, the apparatus comprising:

a flexible and generally tubular attachment member having a tubular axis and being elongated in a direction of the tubular axis, the attachment member being substantially conformable to a shoe of a dancer and for coupling the apparatus with a foot of a dancer; and a tap sound producing member connected to the attachment member.

2. The apparatus according to claim 1 wherein the attachment member comprises a sock having a closed toe end, an open insertion end, and a heel portion.

3. The apparatus according to claim 1 wherein the attachment member comprises a sock sized to fit over a shoe.

4. The apparatus according to claim 1 wherein the sound producing member comprises a metal ring having a central opening.

5. The apparatus according to claim 1 wherein the attachment member comprises an opening, and the tap sound producing member comprises a grommet reinforcing the opening.

6. The apparatus according to claim 1 wherein the attachment member comprises a toe end, and the sound producing member is connected to the attachment member adjacent the toe end.

7. The apparatus according to claim 1 wherein the tap sound producing member comprises a metallic material.

8. The apparatus according to claim 1 further comprising a second tap sound producing member connected to the attachment member.

9. The apparatus according to claim 8 wherein the attachment member comprises a toe end, and the first and second tap sound producing members are juxtaposed to each other and adjacent to the toe end.

10. A tap dance sound producing apparatus for producing a tap sound when utilized by a dancer, the apparatus comprising:

a generally tubular attachment member having a closed toe end, and the attachment member being slidable over a shoe of a dancer; and a tap sound producing member connected to the attachment member.

11. The apparatus according to claim 10 wherein the tap sound producing member comprises a rounded and smooth lower surface.

12. The apparatus according to claim 10 wherein the attachment member comprises a cloth material expandable for enclosing a shoe of a dancer.

13. The apparatus according to claim 10 wherein the attachment member comprises an expandable material for substantially enclosing a shoe of a dancer.

14. The apparatus according to claim 10 further comprising a sole received in the attachment member and positioned between a ground engaging surface of the attachment member and a foot of a dancer received in the attachment member.

15. A tap dance sound producing apparatus for producing tap sound when utilized by a dancer, the apparatus comprising:

a sock having a toe end, an insertion end, a heel portion, and a ground engaging area; and a tap sound producing member connected to the ground engaging surface of the sock.

16. The apparatus according to claim 15 wherein the sock comprises a heavy weight sock having a closed toe end.

17. The apparatus according to claim 15 wherein the sock is sized to substantially enclose a foot of a dancer.

18. The apparatus according to claim 15 further comprising a shoe received in the sock, and the shoe having a sole with a bottom surface.

19. The apparatus according to claim 18 wherein the tap sound producing member is held against the bottom surface of the sole by the sock.

20. The apparatus according to claim 18 wherein the tap sound producing member is generally parallel with the sole.

* * * * *